US006086971A

United States Patent [19]

Haas et al.

[11] Patent Number: 6,086,971

[45] Date of Patent: Jul. 11, 2000

[54] IDENTIFICATION CARD STRIP AND RIBBON ASSEMBLY

[75] Inventors: David J. Haas; Sandra Haas, both of Suffern; Jody P. Sherman, New City, all of N.Y.

[73] Assignee: Temtec, Inc., Suffern, N.Y.

[21] Appl. No.: 08/976,667

[22] Filed: Nov. 24, 1997

Related U.S. Application Data

[63] Continuation of application No. 29/063,584, Dec. 4, 1996, Pat. No. Des. 386,405, and a continuation of application No. 29/065,241, Jan. 27, 1997, abandoned, and a continuation of application No. 29/065,242, Jan. 27, 1997, Pat. No. Des. 394,675, and a continuation of application No. 08/866,939, May 31, 1997, abandoned.

[51] Int. Cl.[7] ..... A44C 3/00; B42D 15/10

[52] U.S. Cl. ..... 428/40.1; 40/1.5; 283/81; 428/42.1; 428/42.2; 428/43; 428/136; 428/137

[58] Field of Search ..... 428/40.1, 42.1, 428/42.2, 43, 136, 137, 4, 5; 40/1.5; 283/81

[56] References Cited

U.S. PATENT DOCUMENTS

| | | | |
|---|---|---|---|
| 4,017,655 | 4/1977 | Mutschler | 428/43 |
| 5,172,938 | 12/1992 | Schmidt | 283/109 |
| 5,700,037 | 12/1997 | Keller | 283/107 |

*Primary Examiner*—Nasser Ahmad
*Attorney, Agent, or Firm*—Michael E. Zall

[57] ABSTRACT

The identification card strip and ribbon assembly includes a support strip having thereon at least one, and preferably a plurality of identification card blanks removably and adhesively adhered to the support strip. Each identification card blank has a front printing surface for printing indicia thereon and a rear adhesive surface having an adhesive thereon. The rear adhesive surface is removably and adhesively adhered to the support strip. The card blank includes a first sheet and a second sheet foldably connected to each other along a fold line. Each sheet has at least one substantially identically shaped aperture therein. Each of the sheets is of a size and shape and the aperture is located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object.

A ribbon print form sheet is provided that can pass through, for example, a laser printer. The sheet has a plurality of ribbons formed in the sheet by score lines that permit the ribbons to be torn from the sheet.

The process for producing the identification cards comprises printing indicia on the printing surface of at least one of the first and second sheets of each card blank, printing indicia on the ribbons of the print form sheet, removing the card blank from the support strip, removing a printed ribbon from the print form sheet, folding the first and second sheets along the fold line upon each other with an end of the ribbon inserted therebetween, the adhesive surfaces joined to each other and holding the ribbon therebetween. The card, including the ribbon, may then be mounted on an object.

5 Claims, 12 Drawing Sheets

IDENTIFICATION CARD STRIP AND RIBBON ASSEMBLY

RELATED APPLICATIONS

This is a continuing application of U.S. Ser. No. 29/063,584, filed on Dec. 04, 1996, (3.1-010) now U.S. Pat. No. D386,405 Ser. No. 29/065,241 (3.1-012) now abandoned and Ser. No. 29/065,242 (3.1-011) filed on Jan. 27, 1997, now U.S. Pat. No. 394,675 all of which are entitled Card Badge; U.S. Ser. No. 08/866,939, filed on May 31, 1997, now abandoned, entitled Identification Card Strip Assembly (3.0-027); U.S. Ser. No. 29/079,020, filed on Nov. 06, 1997 entitled Fishtail Ribbon Print Form (3.1-013); U.S. Ser. No. 29/079,021, filed on Nov. 06, 1997 entitled Slant Ribbon Print Form (3.1-014); and U.S. Ser. No. 029/079,022, filed on Nov. 06, 1997 entitled Pinkered Ribbon Print Form (3.1-015). The entire disclosures of all of these patent applications are incorporated herein by reference.

FIELD OF THE INVENTION

This invention relates to cards and badges for identification and security and specifically to thin paper or cardboard badges including identification ribbons incorporated therein, which can be easily manufactured, printed, written upon and distributed using computerized equipment to provide the capability of customizing printing, color, content and speed of delivery at low costs.

BACKGROUND OF THE INVENTION

A primary disadvantage of known identification cards is that they are generally stiff and relatively thick and cannot pass through, for example, a laser printer. At meetings, conventions and seminars it has become desirable to place large amounts of data on a card, including bar codes, names, company name and address, etc. Further, identification cards that are made of plastic are not "environmentally friendly," they will not biodegrade. To date there has not been an effective system available.

U.S. Pat. Nos. 4,454,180; 4,547,252; and 4,648,930 to La Mers disclose a labeling system employing an elongated label strip used with motor driven sprocket rollers for sequentially delivering labels to a mechanism operable to apply each label to an object. These patents describe a carrier web consisting of a series of labels with viscous pressure sensitive adhesive applied to a carrier strip of paper which has been coated on the label side with a release agent. The labels are removed by moving them sequentially by pulling the carrier strip around a relatively sharp edge under tension. The label, because of its stiffness, releases from the carrier web and continues in a straight line over the edge rather than bend sharply and follow the carrier web. The labels shown in the La Mers patents are mounted on a carrier which employs a center line cut therein to facilitate the rapid and accurate removal of labels.

U.S. Pat. No. 4,925,716 to Haas describes a computerized processing of identification badges employing a base carrier portion in the form of a web carrier. The web carrier has perforated end portions formed integrally therewith so that the sprockets of automated computerized printing equipment can be used to engage the carrier web. The carrier web also is formed into sections via a lateral perforation so that each section is removable, one from the other. The badges are each removably adhesively mounted on individual ones of the sections. The badge may be peeled away from the carrier web without any adhesive remaining on the badge.

The badge employed is relatively stiff, being formed of plastic material, and has an elongated slot formed on the upper central portion thereof so that the badge can be affixed to the person via a spring clip.

There are numerous other patents relating to identification cards and badges, methods of producing them, and their use. See, for example, the following U.S. patents:

| | |
|---|---|
| 2,395,804 to DeGruchy | 4,767,647 to Bree |
| 3,175,317 to Slavsky | 4,790,566 to Boissier |
| 3,996,679 to Warneke | 4,869,941 to Ohki |
| 4,020,575 to Kruger et al | 4,999,065 to Wilfert |
| 4,170,015 to Elliano et al | 5,019,421 to Mecke et al |
| 4,222,662 to Kruegle | 5,106,719 to Oshikoshi et al |
| 4,305,215 to Smith | 5,157,424 to Craven et al |
| 4,579,754 to Maurer et al | 5,161,826 to Van Giesenet al |
| 4,596,409 to Holbein | 5,219,610 to Koshizuka et al |
| 4,680,459 to Drexler | 5,270,073 to Koshizuka et al |
| 4,687,526 to Wilfert | 5,380,695 to Chiang et al |
| 4,692,394 to Drexler | 5,421,619 to Dyball |
| 4,695,173 to Tomida | 5,427,832 to Longtin |

At many conventions and meetings, it has become common practice to further identify particular participants in the meetings by attaching a ribbon with a title on it to the identification badge. These ribbons are attached by an adhesive to hang from the badge. Examples of titles which have been used on these ribbons are "President", "Vice-President", "Board Member", "Press", "Officer", "Membership Committee", "Foundation", and so forth. Of course, many possible titles may be used, depending on the organization and the meeting. Some organizations have imprinted their logo on the ribbons, and others have custom designed ribbons which are specific to the organization.

Such display ribbons have generally had the titles imprinted on the ribbon vertically, so that the word identifying the wearer is read from top to bottom. The ribbons are typically 1.5 inch to 2 inches across and about 6 inches long, with the printing extending vertically along the long dimension of the ribbon from top to bottom. If the individual wearing the badge has participated in several positions or has won several honors, he or she may have several ribbons of different colors hanging from his or her badge.

There are several problems with such prior ribbons. It has usually been a cumbersome job to attach the ribbons to the badges. Further, the ribbons must be preprinted and ordered and can not be printed at, for example, the convention site.

U.S. Pat. No. 5,611,160 to Topitzes, attempted to solve some of these problems. This patent describes horizontally oriented stackable ribbons attached to a display badge through adhesive on each ribbon.

None of these references however provide an inexpensive and easy to use alternative to the relatively thick polymeric badges and holders presently used for seminars, corporate meetings, conferences and/or describe the easy incorporation of printed ribbons therein.

OBJECTS AND SUMMARY OF THE INVENTION

An object of this invention is to provide an identification card or badge system, including ribbons, which can be easily automated using computer equipment to rapidly imprint badges and ribbons with computer stored information.

Another object of this invention is to provide an identification badge or card, including ribbons therefore, which can be generated at the location where the same will be used, such as at a trade show.

Yet another object of the invention is to provide an identification card strip assembly and ribbons therefore, wherein the cards and ribbons can be made of thin paper or cardboard, printed thereon with, for example a laser printer, and then assembled into a sturdy, relatively thick identification card with a ribbon.

All of the foregoing objects of this invention are achieved by the identification card strip and ribbon assembly of this invention and the process of using it to produce the identification cards described herein. Broadly, the identification card strip and ribbon assembly comprises a support strip having thereon at least one, and preferably a plurality of identification card blanks removably and adhesively adhered to the support strip. Each identification card blank has a front printing surface for printing indicia thereon and a rear adhesive surface having an adhesive thereon. The rear adhesive surface is removably and adhesively adhered to the support strip. The card blank includes a first sheet and a second sheet foldably connected to each other along a fold line. Each sheet has at least one substantially identically shaped aperture therein. Each of the sheets is of a size and shape and the aperture is located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object.

A ribbon print form sheet is provided that can pass through, for example, a laser printer. The sheet has a plurality of ribbons formed in the sheet by score lines that permit the ribbons to be torn from the sheet.

The process for producing the identification cards comprises printing indicia on the printing surface of at least one of the first and second sheets of each card blank, printing indicia on the ribbons of the print form sheet, removing the card blank from the support strip, removing a printed ribbon from the print form sheet, folding the first and second sheets along the fold line upon each other with an end of the ribbon inserted therebetween, the adhesive surfaces joined to each other and holding the ribbon therebetween. The card, including the ribbon, may then be mounted on an object.

These as well as further objects and advantages of the invention will become apparent to those skilled in the art from a review of the following detailed specification, reference being made to the accompanying drawings.

DETAILED DESCRIPTION OF THE INVENTION

Figure 2:
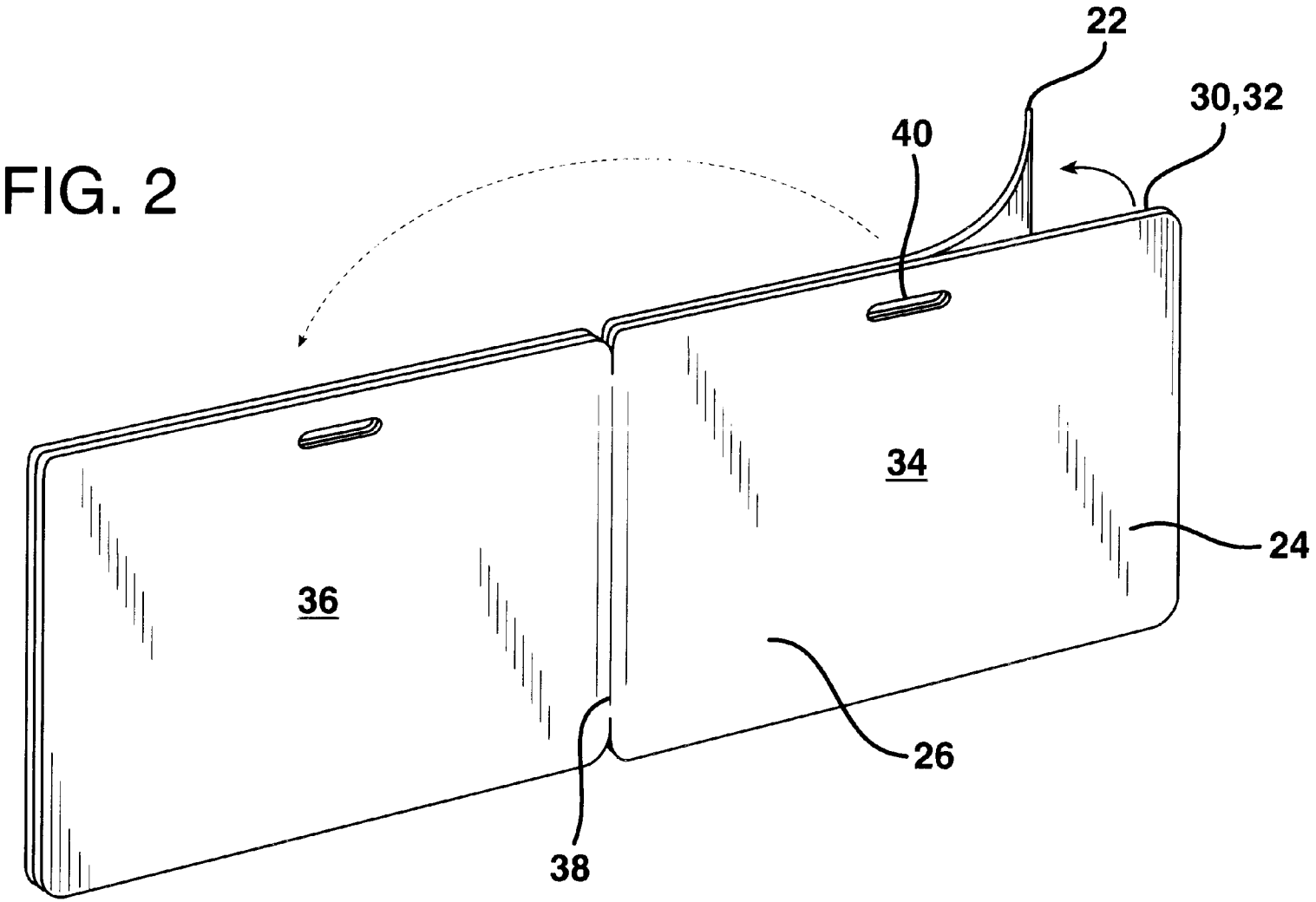
FIG. 2 is a schematic perspective indicating how the identification card of FIG. 1 is assembled without a ribbon.
Figure 3:
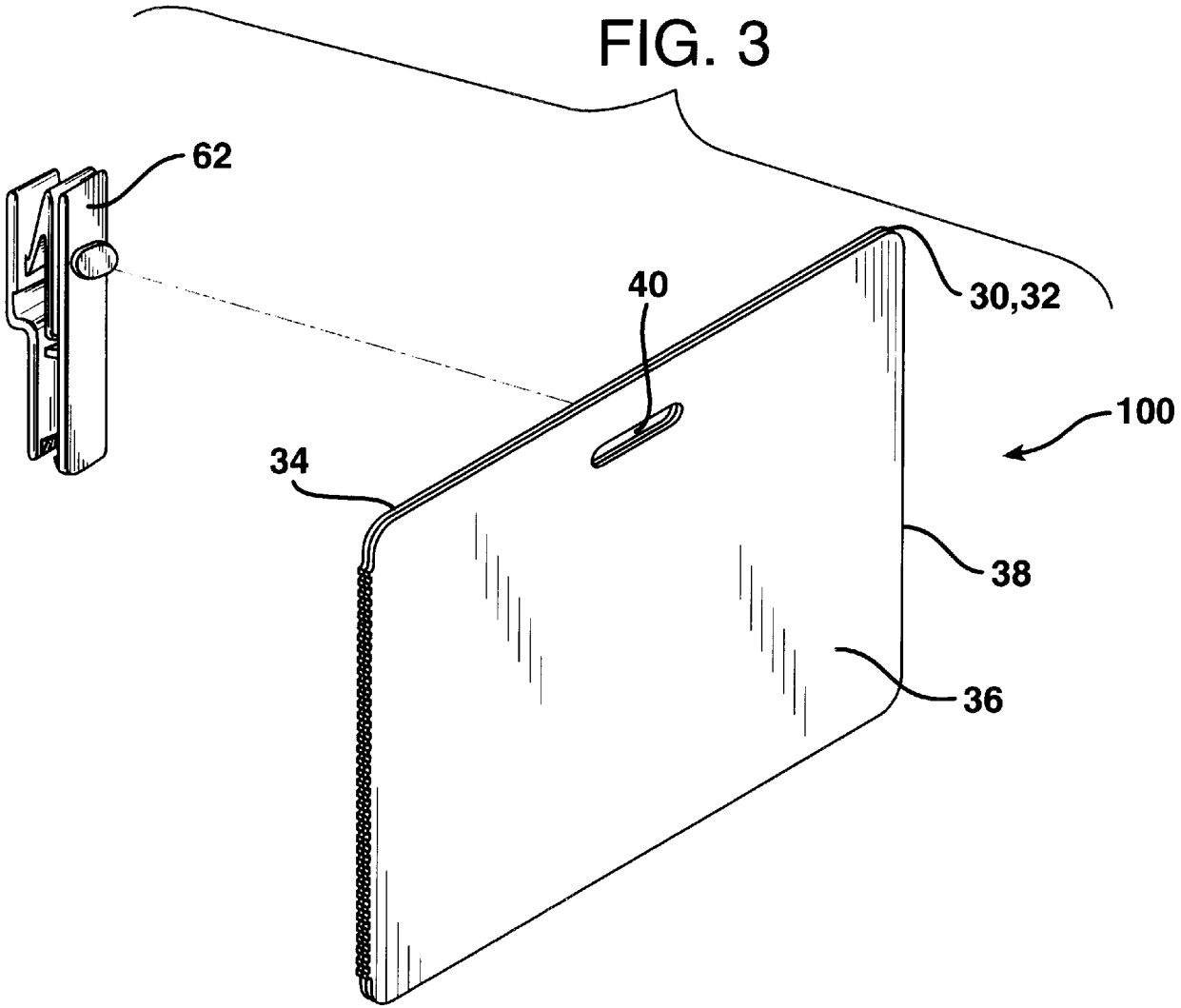
FIG. 3 is a schematic perspective indicating how the assembled card of FIGS. 1 and 2 is placed on a badge clip.
Figure 4:
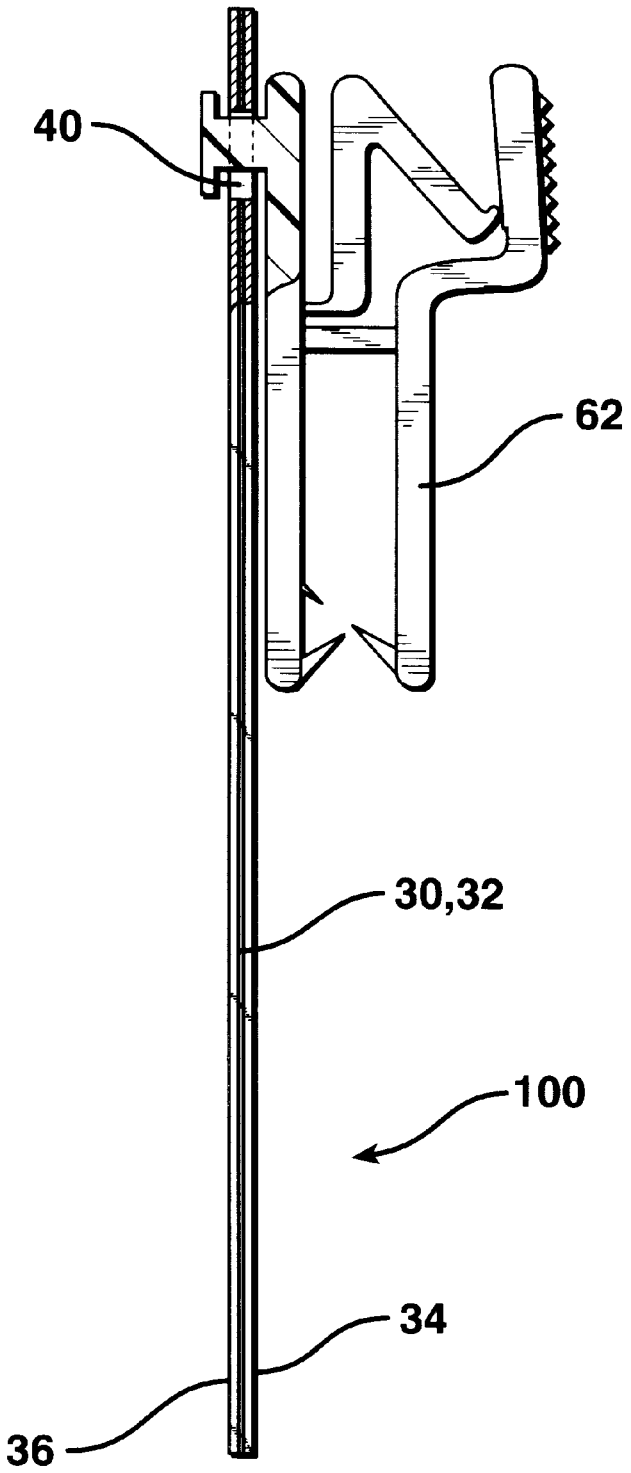
FIG. 4 is a sectional view of the card badge of FIG. 1 taken along line 4—4 of FIG. 1.

Referring, for example, to FIG. 2, an identification card strip assembly is provided. This identification card strip assembly is substantially identical to that described in U.S. Ser. No. 08/866,939, filed on May 31, 1997, entitled Identification Card Strip Assembly, the entire disclosure of which is incorporated herein by reference. Generally, the assembly comprises a support strip 22 having at least one, and preferably a plurality of identification card blanks 24 removably and adhesively adhered to the support strip 22. Preferably, the support strip 22 is an elongated strip 22 and may have pin-holes or perforations along the longitudinal edges of the strip 22 to permit driving of the strip through an associated printing device similar to 46 in FIG. 5. A major advantage of this card strip assembly is that a standard laser type printer 48, see FIG. 6, may be used to print the identification card blanks 24. If such an embodiment is used then the support strip 22 may be a standard 8½ inch by 11 inch sheet having a plurality of card blanks 24 appropriately arranged. Optionally, although not shown, the support strip may be envelope size (#10) and have only one card blank thereon and fed to the printer in a manner similar to an envelope.

Referring, for example, to FIGS. 10–14, a ribbon print form (210, 310, 410, 220 and 230, respectively) is provided. Generally, the ribbon print form comprises a sheet having at least one, and preferably a plurality of ribbons (e.g., 110, 210, and 310 in FIGS. 10–12, respectively) formed in the print form by score lines. The ribbons may be detached from each other along such score lines. The print form may have pin-holes or perforations along the longitudinal edges to permit driving of the strip through an associated printing device 46, see FIG. 5. A major advantage of this invention is that a standard laser type printer 48, see FIG. 6, may be used to print the ribbons. If such an embodiment is used then the print form may be a standard 8½ inch by 11 inch sheet having a plurality of ribbons appropriately arranged. (See, FIG. 6). The ribbons may be vertically disposed, as depicted in the Figures, or may be horizontally disposed (not shown).

Figure 10:
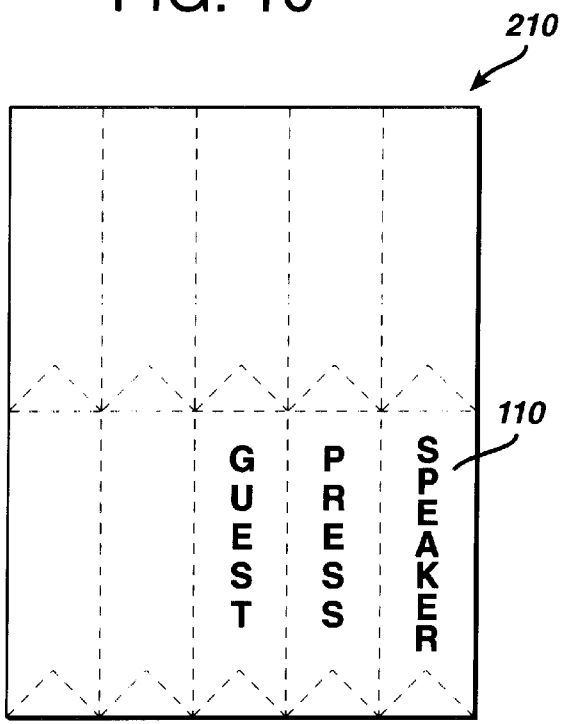
Figure 14:
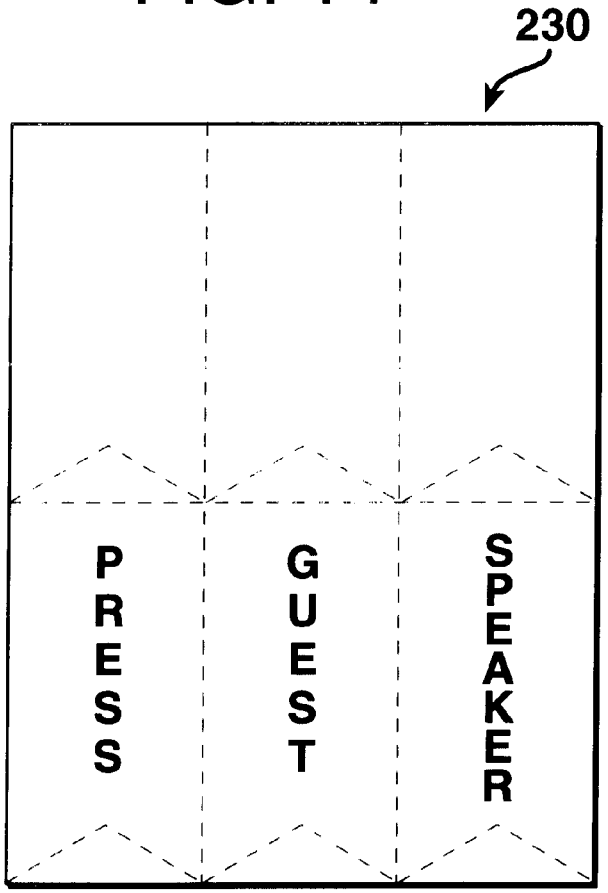
FIGS. 13 and 14 are elevational views of a ribbon print form scored with different sized fishtail ribbons.
Figure 13:
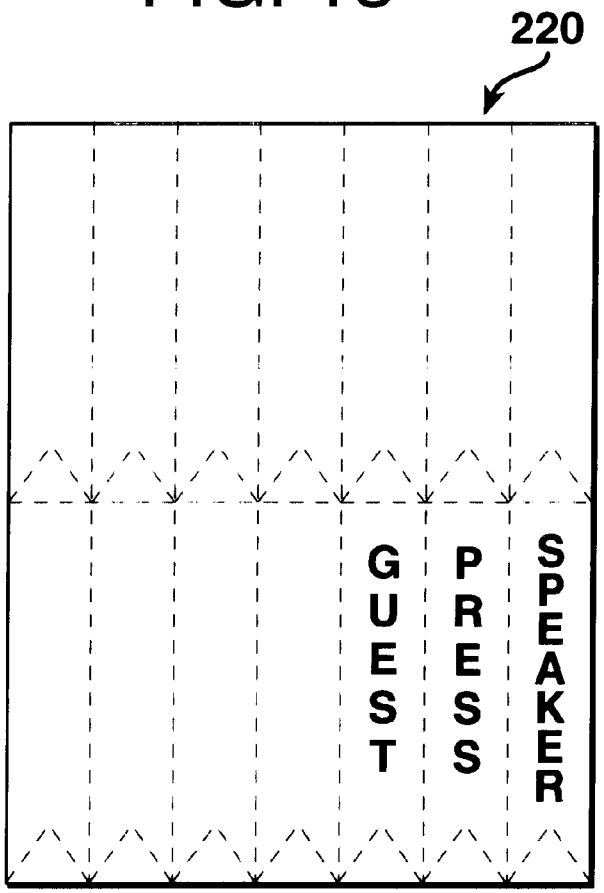

The ribbons may have one end shaped as a fishtail (FIGS. 10, 13 & 14), slant cut (FIG. 11) or "pinkered" (FIG. 12) and may be of various sizes and number on the print form, e.g., compare FIGS. 10, 13, & 14. Preferably, the ribbon print forms are made of a tough, cloth-like, paper stock or polymer upon which laser printing can be performed. A preferred material is Prevale, a machine washable fabric produced by Kimberly-Clark, Inc.

Figure 1:
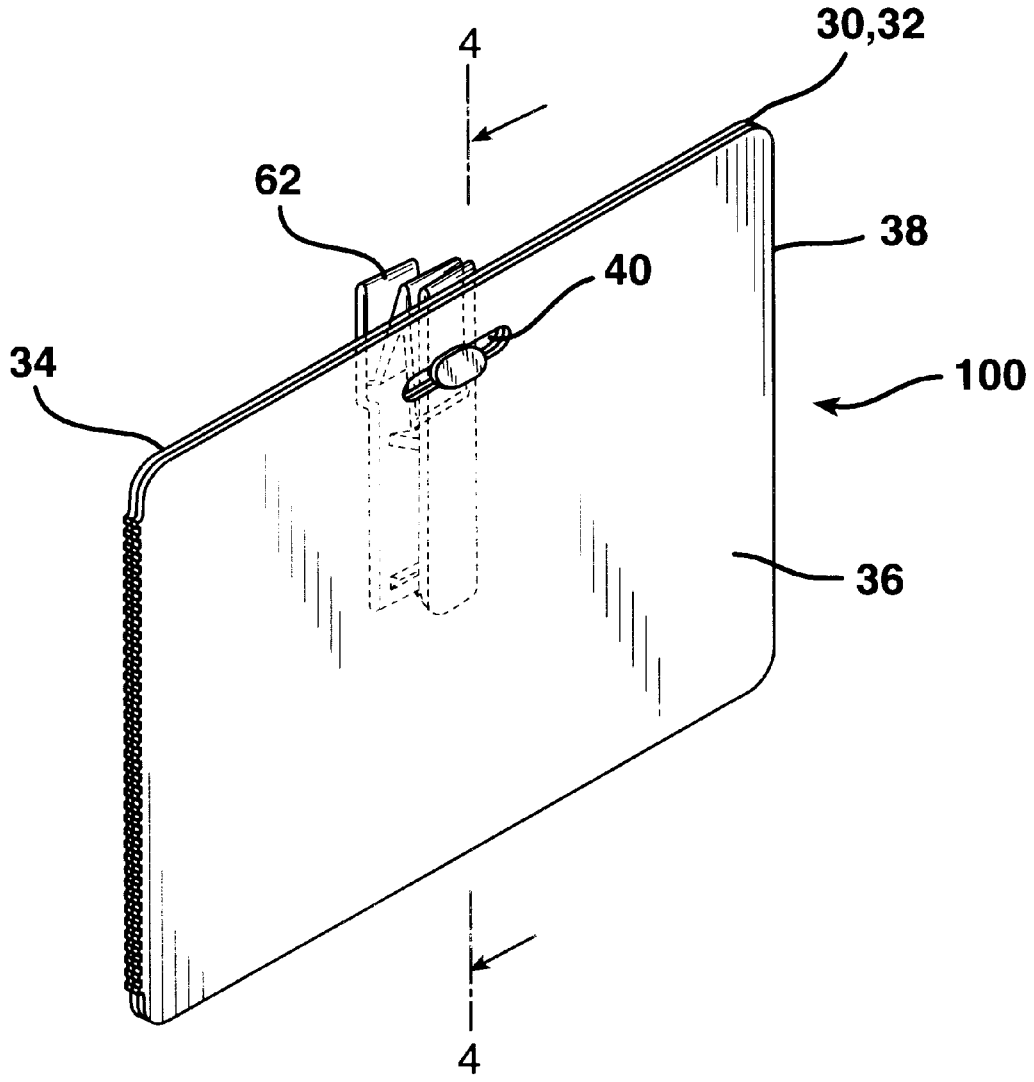
FIG. 1 is a perspective view of an embodiment of the identification card badge of this invention in use without a ribbon.

Referring, for example, to FIGS. 1 and 2, each identification card blank 24 has a front printing surface 26 for printing indicia 28 thereon and a rear adhesive surface 30 having an adhesive 32 thereon. The rear adhesive surface 30 is removably and adhesively adhered to the support strip 22.

The card blank 24 includes a first sheet 34 and a second sheet 36 foldably connected to each other along a fold line 38. Each sheet 34,36 has at least one substantially identically shaped aperture therein 40. Each sheet 34, 36 is of a size and shape and each aperture 40 is located in each sheet 34,36 so that when the card blank 24 is removed from the support strip 22 and the sheets are folded along the fold line 38 upon each other with the adhesive surfaces 30 joined to each other, the first sheet 34 and second sheet 36 are substantially superimposed upon each other and substantially coextensive with each other and the apertures 40 in each sheet 34, 36 overlay each other to form a mounting means for mounting the card 24 on an object.

Preferably, the plurality of card blanks 24 are formed from a continuous sheet and defined by plurality of lateral slits extending across the sheet at substantially equal longitudinal intervals. The card blanks 24 are then severable from each other along the slits. Optionally, the plurality of card blanks 24 may be formed from a continuous sheet and defined by a plurality of lateral slits extending across the sheet at substantially equal longitudinal intervals and a plurality of longitudinal slits extending across the sheet at substantially equal lateral intervals, the card blanks 24 being severable from each other along the slits . The card blanks may also be spaced apart on the support sheet to permit easy peeling therefrom.

Figure 6:
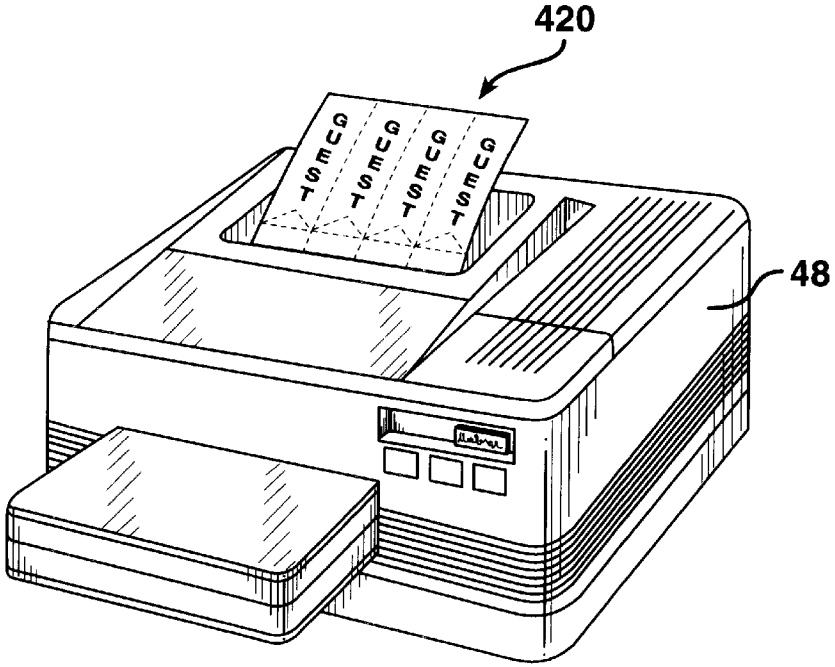
FIG. 6 is schematic view showing another embodiment of a ribbon print form having a plurality of the ribbons being printed with a laser printer prior to assembly and use.
Figure 5:
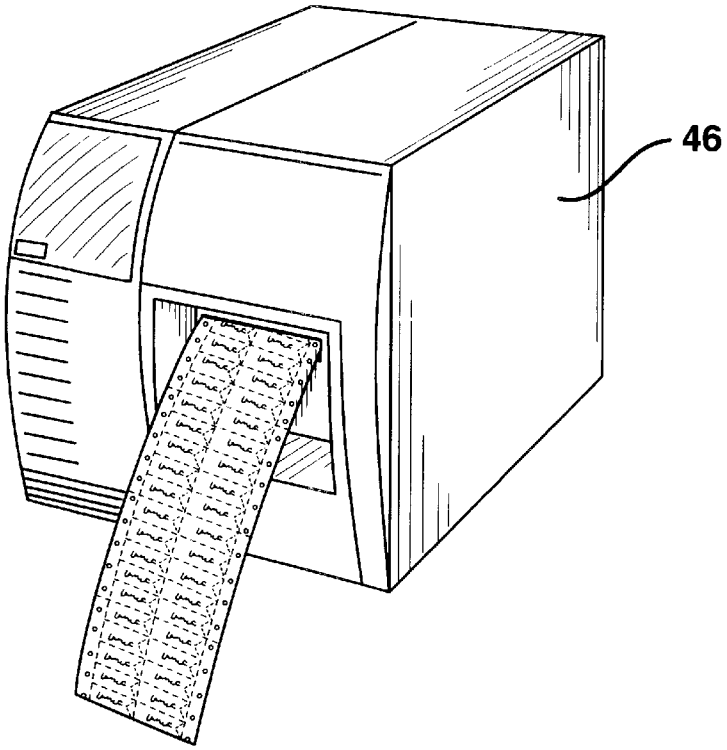
FIG. 5 is schematic view showing one embodiment of a ribbon print form having a plurality of the ribbons being printed with a pin-feed type printer prior to assembly and use.
Figure 15:
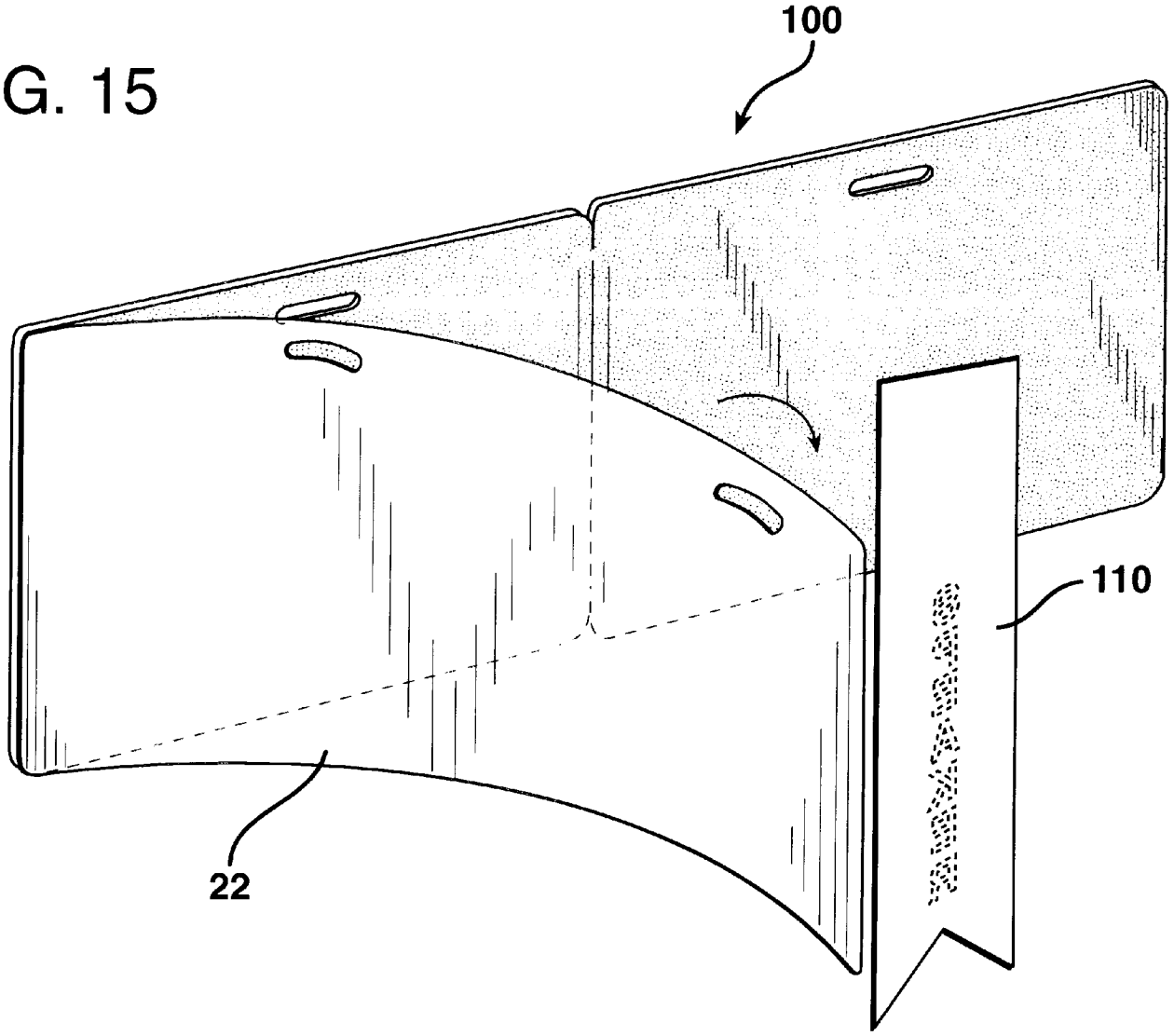
FIG. 15 is a schematic perspective indicating how the identification card of FIG. 1 is assembled with a ribbon.
Figure 16:
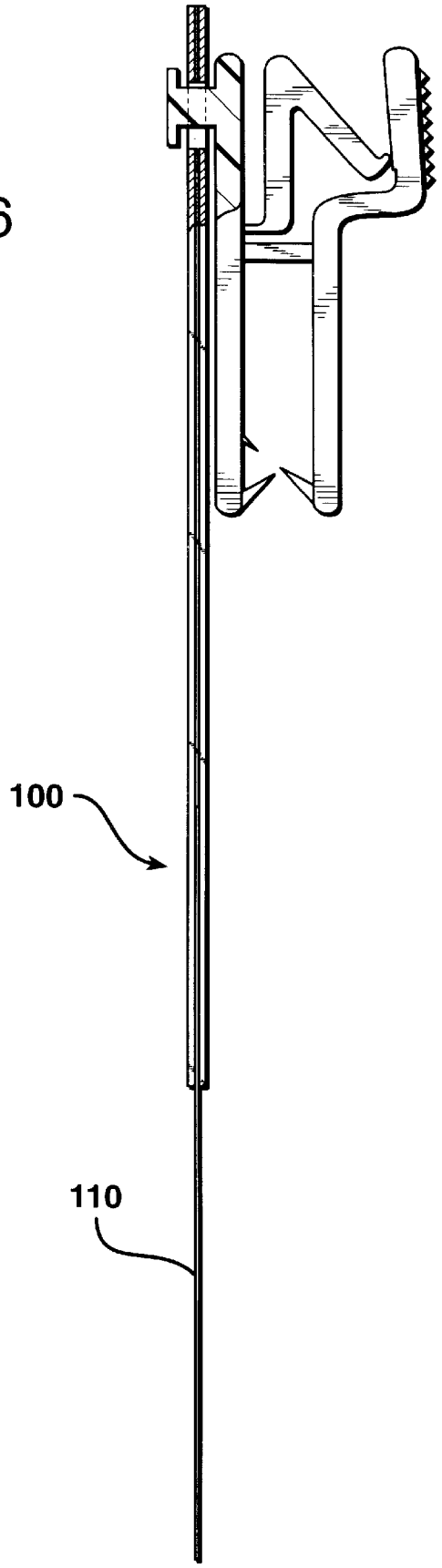
FIG. 16 is a sectional view of the assembled card badge of FIG. 1 taken along line 4—4 of FIG. 1 with the ribbon therein.

The process for producing the plurality of identification cards includes printing indicia, by for example printers shown in FIGS. 5 and 6 on the printing surface 26 of at least one of the first and second sheets 34, 36 of each card blank 26. Additionally, indicia (e.g., PRESS, SPEAKER, GUEST, etc.) are printed on a plurality of ribbons, as shown for example in FIGS. 5 and 6, by passing the ribbon print form, (FIGS. 10–14; 210, 310, 410, 220 and 230, respectively) through the printers 46, 48. Subsequently, the card blank 24 is removed from the support strip 22 (see FIGS. 2, and 15) and a ribbon 110 is removed from the print form. The first and second sheets 34,36 are then folded along the fold line 38 upon each other with the end of the ribbon 110 placed on one of the adhesive surfaces 30. The adhesive surfaces 30 are then joined to each other, securing the ribbon in place. This produces an identification card 100 having the first sheet and second sheets 34, 36 substantially superimposed upon each other and substantially coextensive with each other with an appropriate ribbon secured therebetween. The apertures in each sheet 34, 36 overlaying each other to form a mounting means for mounting the card on an object.

The identification card produced 100 is a laminate consisting of two sheets of cardstock having an adhesive layer and an end of a ribbon therebetween. The card is relatively rigid due to such lamination and the ribbon secure from accidental removal.

Preferably, the assembled identification card 100 is mounted on a spring badge clip 62. See, for example FIGS. 1, 3, 4, 7–9 and 16. Such clips are known in the art, see for example, U.S. Des. Pat. No. 386,215 (31009) and U.S. Pat. No. 5,640,742 (30021) both to White et al and both entitled "Spring Badge Clip". The entire disclosures of these applications are incorporated by reference. Other type clips may also be used.

Figure 7:
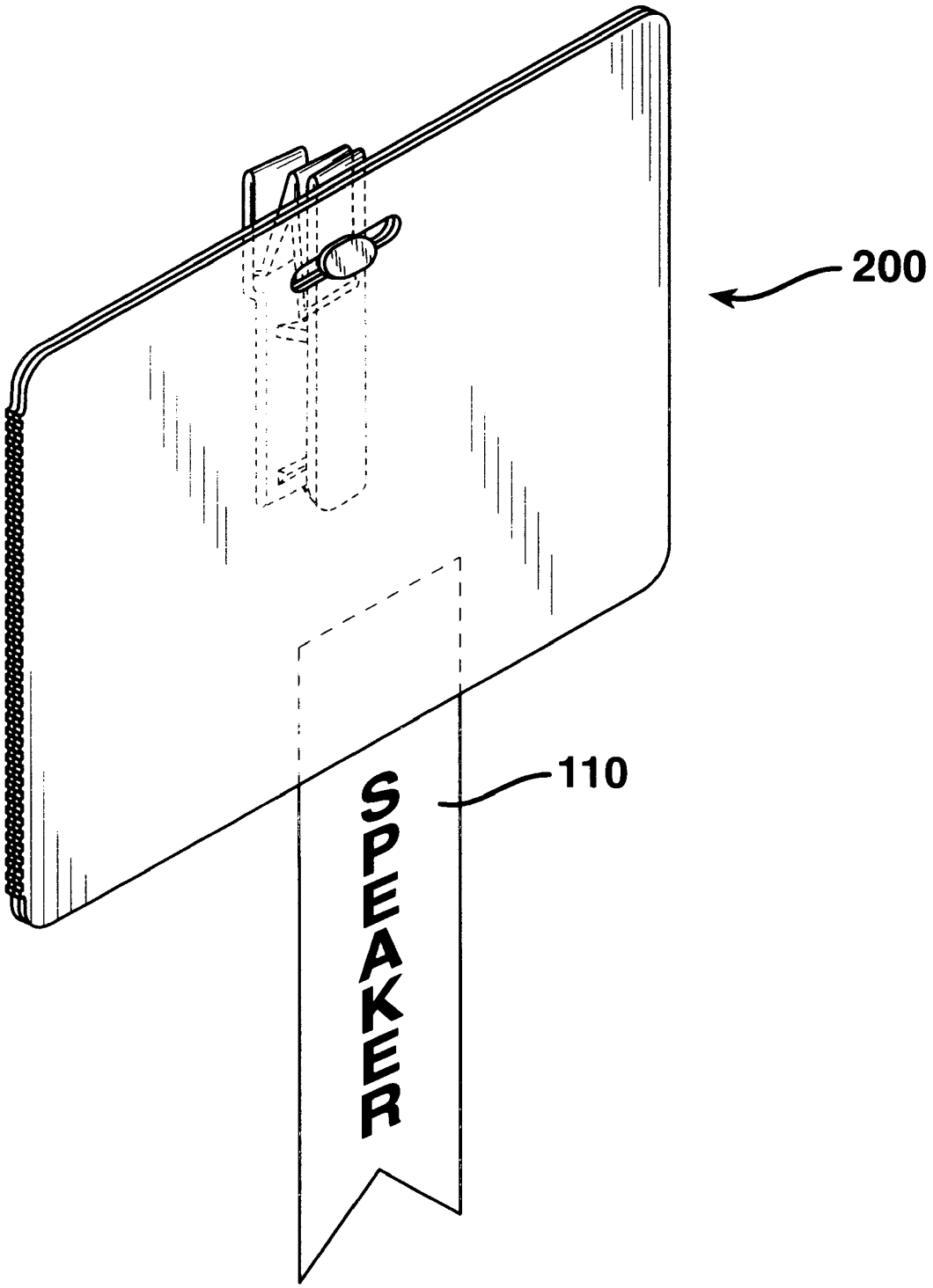
FIG. 7 is a perspective view of an embodiment of the identification card badge of this invention in use with a "fishtail ribbon"
Figure 8:
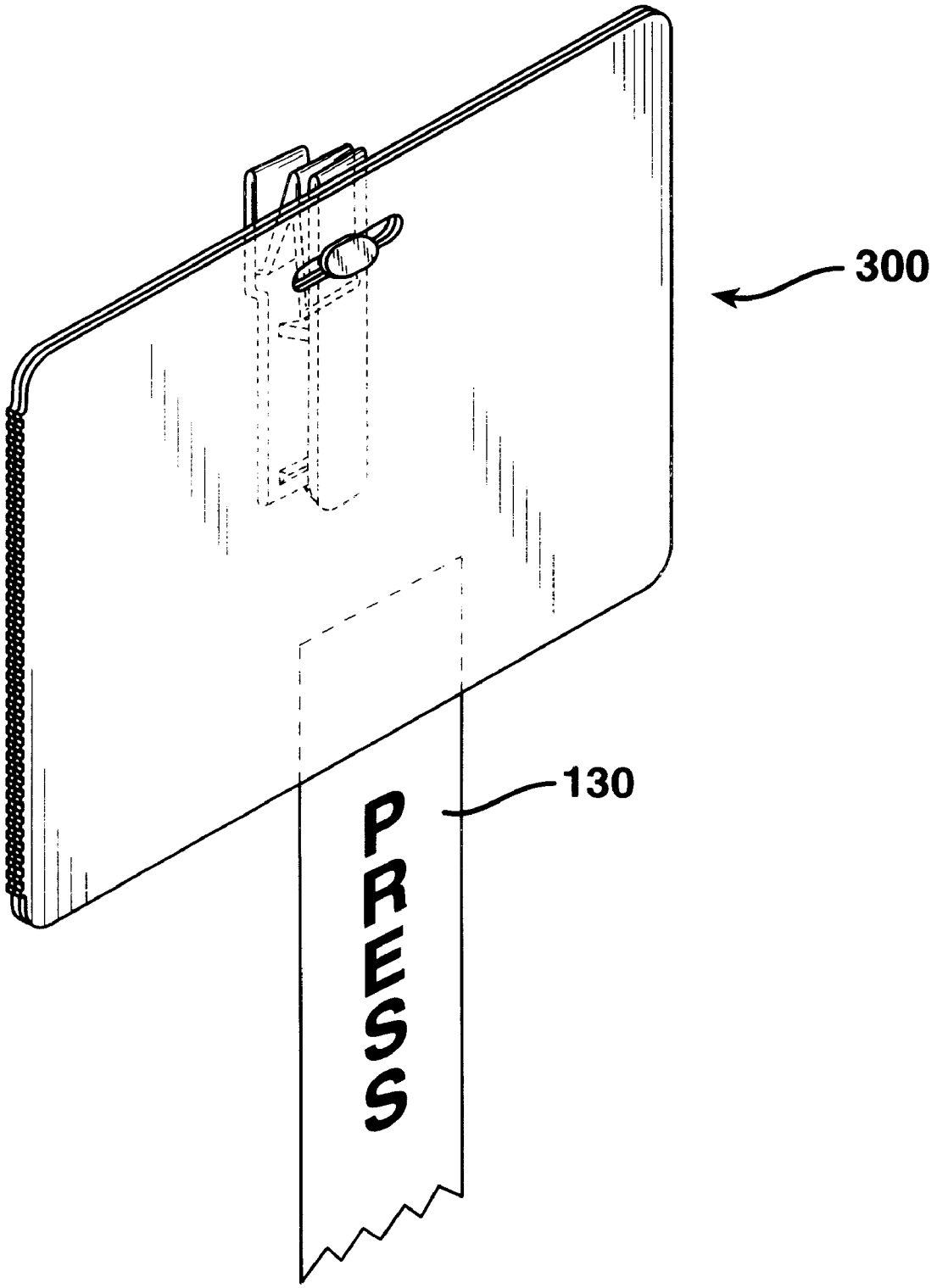
FIG. 8 is a perspective view of an embodiment of the identification card badge of this invention in use with a "pinkered ribbon"
Figure 9:
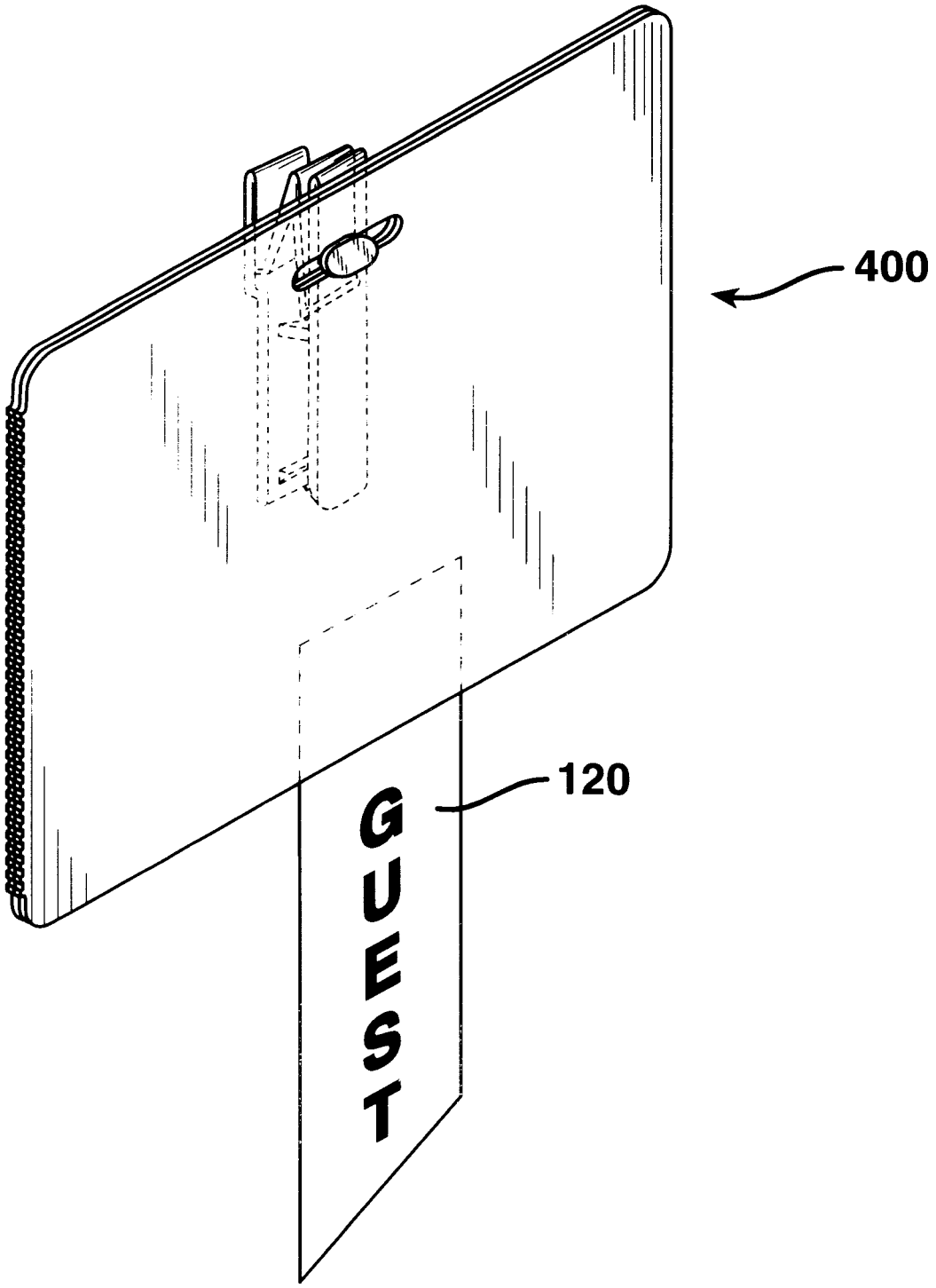
FIG. 9 is a perspective view of an embodiment of the identification card badge of this invention in use with a "slant ribbon"
Figure 12:
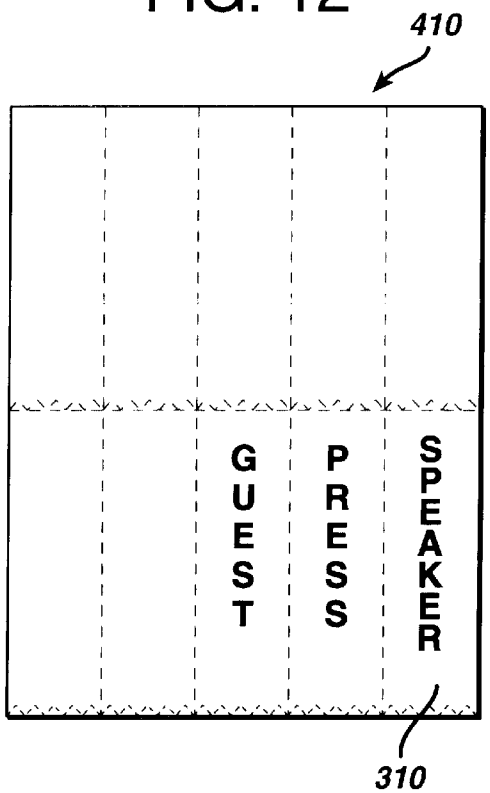
FIGS. 10, 11 and 12 are elevational views of a ribbon print form scored with fishtail, slant and pinkered ribbons, respectively.
Figure 11:
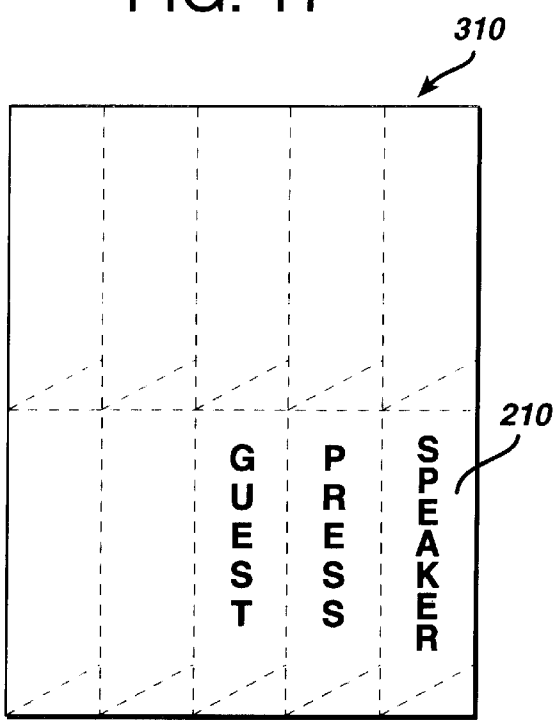

FIGS. 7, 8, and 9, depict the assembled identification cards (200, 300, and 400, respectively) with a fishtail ribbon 110, pinkered ribbon 130, and slant ribbon 120 securely mounted therein.

This invention has many benefits. For example, in its preferred embodiment, the identification card strip assembly 20 can be used to produce a 2-ply, relatively heavy duty cardstock identification cards with ribbons, wherein the ribbon and the front and back of the card can be custom printed at the place of distribution and the identification cards 100 produced are preslotted so that they can be used with clips, e.g., the badge clips of White et al.

While several advantageous embodiments have been chosen to illustrate the invention, it will be understood by those skilled in the art that various changes and modifications can be made therein without departing from the scope of the invention as defined in the appended claims.

What is claimed is:

1. A combination identification card strip and ribbon assembly comprising:

a support strip;

at least one identification card blank overlaying and removably and adhesively adhered to the support strip;

each identification card blank comprising:

a front printing surface for printing indicia thereon and a rear adhesive surface having an adhesive thereon completely covering the rear surface, the rear adhesive surface being removably and adhesively adhered to the support strip, the adhesive remaining on each card blank after being removed from the support strip;

the card blank including a first sheet and a second sheet foldably connected to each other along a fold line;

each sheet having at least one substantially identically shaped aperture therein;

each sheet being of a size and shape and each aperture located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object;

an elongated ribbon print form comprising a printable sheet having a plurality of score lines running the length of the form and a plurality of score lines running the width of the form to form a plurality of ribbons that may be removed from the sheet by tearing along the score lines, one end of each ribbon adapted to be placed between the sheets when they are folded along the fold line upon each other with the adhesive surfaces joined to each other to be secured therebetween.

2. The combination identification card strip and ribbon assembly of claim 1, wherein a plurality of the card blanks are formed from a continuous sheet and defined by a plurality of lateral slits extending across the sheet at substantially equal longitudinal intervals, the card blanks being severable from each other along the slits.

3. The combination identification card strip and ribbon assembly of claim 1, wherein a plurality of card blanks are formed from a continuous sheet and defined by a plurality of lateral slits extending across the sheet at substantially equal longitudinal intervals and a plurality of longitudinal slits extending across the sheet at substantially equal lateral intervals, the card blanks being severable from each other along the slits.

4. The combination identification card strip and ribbon assembly of claim 1, wherein the support strip has pin-hole perforations along the longitudinal edges of the strip to permit driving of the strip through an associated pin-feed printing device.

5. The combination identification card strip and ribbon assembly of claim 1, wherein the ribbon print form has pin-hole perforations along the longitudinal edges of the form to permit driving of the form through an associated pin-feed printing device.

* * * * *